United States Patent [19]

Stewart et al.

[11] 4,445,443

[45] May 1, 1984

[54] FLUIDIZED BED HEAT EXCHANGER HAVING SEPARATING DRAIN AND METHOD OF OPERATION THEREOF

[75] Inventors: Robert D. Stewart, Verona; Thomas E. Taylor, Bergenfield, both of N.J.

[73] Assignee: Foster Wheeler Energy Corporation, Livingston, N.J.

[21] Appl. No.: 542,093

[22] Filed: Oct. 17, 1983

Related U.S. Application Data

[63] Continuation of Ser. No. 364,163, Mar. 31, 1982, abandoned, which is a continuation-in-part of Ser. No. 190,299, Sep. 24, 1980, Pat. No. 4,335,661.

[51] Int. Cl.[3] ..... F23G 7/00

[52] U.S. Cl. ..... 110/245; 110/347; 122/4 D; 432/58

[58] Field of Search ..... 110/245, 347; 432/58; 122/40; 34/57 A, 102

[56] References Cited

U.S. PATENT DOCUMENTS

| | | | |
|---|---|---|---|
| 3,881,857 | 5/1975 | Hoy et al. | 431/7 |
| 4,177,742 | 12/1979 | Uemura et al. | 110/245 |
| 4,227,488 | 10/1980 | Stewart et al. | 110/245 |
| 4,240,364 | 12/1980 | Bryers et al. | 110/245 |
| 4,253,425 | 3/1981 | Gamble et al. | 110/245 |
| 4,335,661 | 6/1982 | Stewart et al. | 122/4 D |
| 4,349,969 | 9/1982 | Stewart et al. | 122/4 D |
| 4,359,326 | 11/1982 | Hoffert et al. | 122/4 D |

FOREIGN PATENT DOCUMENTS

| | | | |
|---|---|---|---|
| 2303452 | 8/1973 | Fed. Rep. of Germany | 110/245 |
| 769267 | 3/1957 | United Kingdom . | |

*Primary Examiner*—Henry C. Yuen

*Attorney, Agent, or Firm*—Marvin A. Naigur; John E. Wilson

[57] ABSTRACT

A fluidized bed heat exchanger having a perforated support plate supporting relatively lightweight absorbent material particles and relatively heavy fuel ash particles includes a drain through which a flow of air defining a separating air screen retains the adsorbent material particles in the bed but allows the fuel ash particles to fall into the drain.

9 Claims, 2 Drawing Figures

FLUIDIZED BED HEAT EXCHANGER HAVING SEPARATING DRAIN AND METHOD OF OPERATION THEREOF

This application is a continuation of Ser. No. 364,163, filed on Mar. 31, 1982, now abandoned, which is a continuation-in-part of Ser. No. 190,299, filed Sept. 24, 1980, now U.S. Pat. No. 4,335,661.

BACKGROUND OF THE INVENTION

This invention relates to a fluidized bed heat exchanger and, more particularly, to a heat exchanger in which heat is generated by the combustion of particulate fuel in a fluidized bed and a method of operation thereof.

The use of fluidized beds has long been recognized as an attractive way of generating heat. In a normal fluidized bed arrangement, air is passed through a perforated plate or grid supporting particulate material which usually includes a mixture of a fuel material, such as high sulfur bituminous coal, and an adsorbent material for adsorbing the sulfur released as a result of the combustion of the coal. As a result of the air passing through the bed, the bed behaves like a boiling liquid which promotes the combustion of the fuel. The basic advantages of such an arrangement include a relatively high heat transfer rate, substantially uniform bed temperature, combustion at relatively low temperatures, ease of handling the coal, a reduction in corrosion and boiler fouling and a reduction in boiler size.

In the fluidized bed combustion process, the coal and adsorbent are continuously introduced into the bed by suitable feeders, injectors, or the like, and coal ash and adsorbent are discharged from the lower portion of the bed, usually through a gravity drain pipe having an entrance registering with a discharge opening formed through the perforated support plate and a distal end communicating with a screw cooler, a conveyor belt, or the like. However, in arrangements in which the size of the coal extends over a relatively large range, relatively heavy pieces of coal ash tend to migrate to an area above the drain pipe and form a dense area that is difficult, if not impossible, to fluidize. As a result, the heavy pieces of coal ash do not drain, but rather cause a clogging of the drain pipe and an attendant severe curtailment in the operating efficiency of the bed.

Furthermore, in the operation of the fluidized bed, in order to maximize heat transfer efficiency, it is desirable to maintain close control over the level of material in the bed. Precise control is difficult to achieve in a fluidized bed in which new material is continuously being introduced, if the drain tends to become clogged. Moreover, it is desirable to not only maintain a continuously controllable discharge through the drain, but it is also desirable to retain the relatively light adsorbent material particles in the fluidized bed, while permitting only the relatively heavy coal ash particles to discharge through the drain. In this manner, the adsorbent material is retained in the fluidized bed for a longer time to adsorb more sulfur from the combustion of the coal and, as a result, less new adsorbent material need be continuously introduced. There is an acceptable loss or attrition of adsorbent material in the normal operation of the bed by the reduction of the adsorbent material to fine particle size due to the boiling action of the bed and the grinding of the particles against one another, and by the entrainment of the fine adsorbent material particles in the fluidizing gas, by which they are carried out through the flue.

SUMMARY OF THE INVENTION

It is therefore an object of the present invention to provide a fluidized bed heat exchanger and method of operating the same in which all of the coal is fluidized and in which the coal ash is prevented from clogging the drain pipe.

It is another object of the present invention to provide a fluidized bed heat exchanger and method of operation in which the coal ash is permitted to discharge through the drain pipe, but the adsorbent material is prevented from doing so.

It is still another object of the present invention to provide a fluidized bed heat exchanger and method of operation in which the level of the fluidized bed is precisely controlled.

Toward the fulfillment of these and other objects, the fluidized bed heat exchanger of the present invention includes a perforated plate supporting a fluidized bed of particulate material and a drain pipe to which a source of compressed air is connected to flow upwardly through the drain pipe and into the material of the fluidized bed above the drain pipe, thereby preventing the heavy pieces of coal ash from accumulating. The upward flow of air also results in a low density area in the fluidized bed in a generally conical region above the inlet to the drain pipe, thereby providing less support for the particulate material in the region above the drain pipe. Therefore, the heavier particles of the fluidized bed tend to migrate toward the low density region and to sink into the drain pipe. The flow of compressed air is selected so that it comprises a separating air screen by which the relatively light particles of adsorbent material are buoyed and lifted upwardly, while the heavier coal ash particles are pulled by gravity down through the upwardly flowing compressed air into the drain pipe. Thus, the area in the fluidized bed around the inlet to the drain pipe is kept free of any accumulation of material, and the light adsorbent material particles are retained in the fluidized bed, while the heavier coal ash particles are allowed to continuously and freely discharge through the drain pipe. Since the coal ash particles drain freely, they discharge at a relatively constant rate, so that the rate of particulate material flowing into the fluidized bed can be adjusted, whereby the level of the fluidized bed can be precisely controlled.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in connection with the accompanying drawings in which.

DETAILED DESCRIPTION OF THE PREFERRED EMBODIMENT

Figure 1:
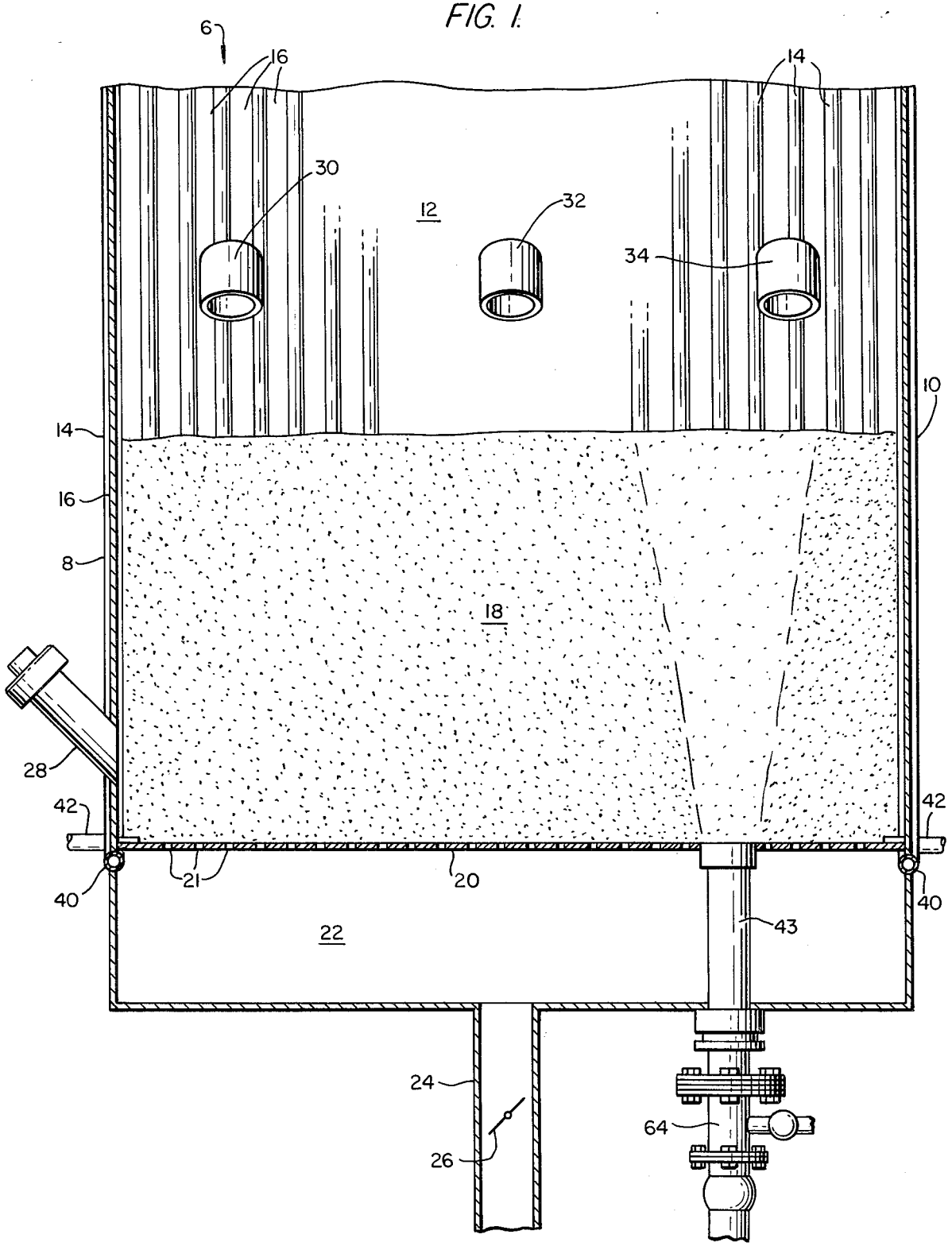
FIG. 1 is a vertical sectional view of the fluidized bed heat exchanger of the present invention.

As is illustrated in FIG. 1 of the drawings, the reference numeral 6 refers in general to an enclosure forming a major portion of a fluidized bed heat exchanger which may be in the form of a boiler, a combustor, a process reactor or any similar device. The enclosure 6 comprises a front wall 8, a rear wall 10, and two sidewalls, one of which is shown by the reference numeral 12. Each wall is formed by a plurality of vertically extending tubes 14 disposed in spaced, parallel relationship and connected together by a plurality of elongated fins 16 extending for the entire lengths of the tubes 14 and connected to diametrically opposed surfaces of the tubes in a conventional manner. The upper portion of the enclosure 6 is not shown for the convenience of presentation, it being understood that it comprises a convection section, a roof and an outlet for allowing the combustion gases to discharge, also in a conventional manner.

A bed of particulate material, shown in general by the reference numeral 18, is disposed within the heat exchanger 6 and rests on a plate 20 extending horizontally in the lower portion of the heat exchanger and having a plurality of perforations 21. The bed 18 can comprise a mixture of discrete particles of fuel material, such as bituminous coal, and an adsorbent, such as limestone, for adsorbing the sulfur released by the combustion of the fuel material.

An air plenum 22 is provided immediately below the perforated plate 20 and an air inlet pipe 24 is provided through the plenum for distributing air from an external source (not shown) to the plenum under the control of a valve 26. Since the valve 26 can be of a conventional design, it will not be described in any further detail. A bed light-off burner 28 is mounted through the front wall 18 immediately above the plate 20 for initially lighting off the bed 18 during startup.

Three overbed feeders 30, 32 and 34 are provided which extend through a sidewall 12. The feeders 30, 32 and 34 receive particulate coal from inlet ducts or the like, and are controlled by valves or other flow control devices to feed the coal particles onto the upper surface of the bed 18. The feeders 30, 32 and 34 can operate by gravity discharge or can be in the form of spreader feeders or any other similar device. It is understood that feeders identical to the feeders 30, 32 and 34 and controlled by identical devices can also be provided through one or more of the front wall 8, the rear wall 10 and the other side wall 12, and that similar feeders and control devices can also be provided for discharging the adsorbent onto the bed 18.

A pair of horizontal headers 40 are connected in fluid communication with the tubes 14 forming the front wall 8 and the rear wall 10, and another pair of horizontal headers 42 are connected in fluid communication with the tubes 14 forming the side walls 12. It is understood that headers similar to the headers 40 and 42 are provided in communication with the upper ends of the walls 8, 10 and 12. As a result, a fluid to be heated can be sequentially or simultaneously passed through the walls 8, 10 and 12 to pick up the heat from the fluidized bed in a conventional manner.

Figure 2:
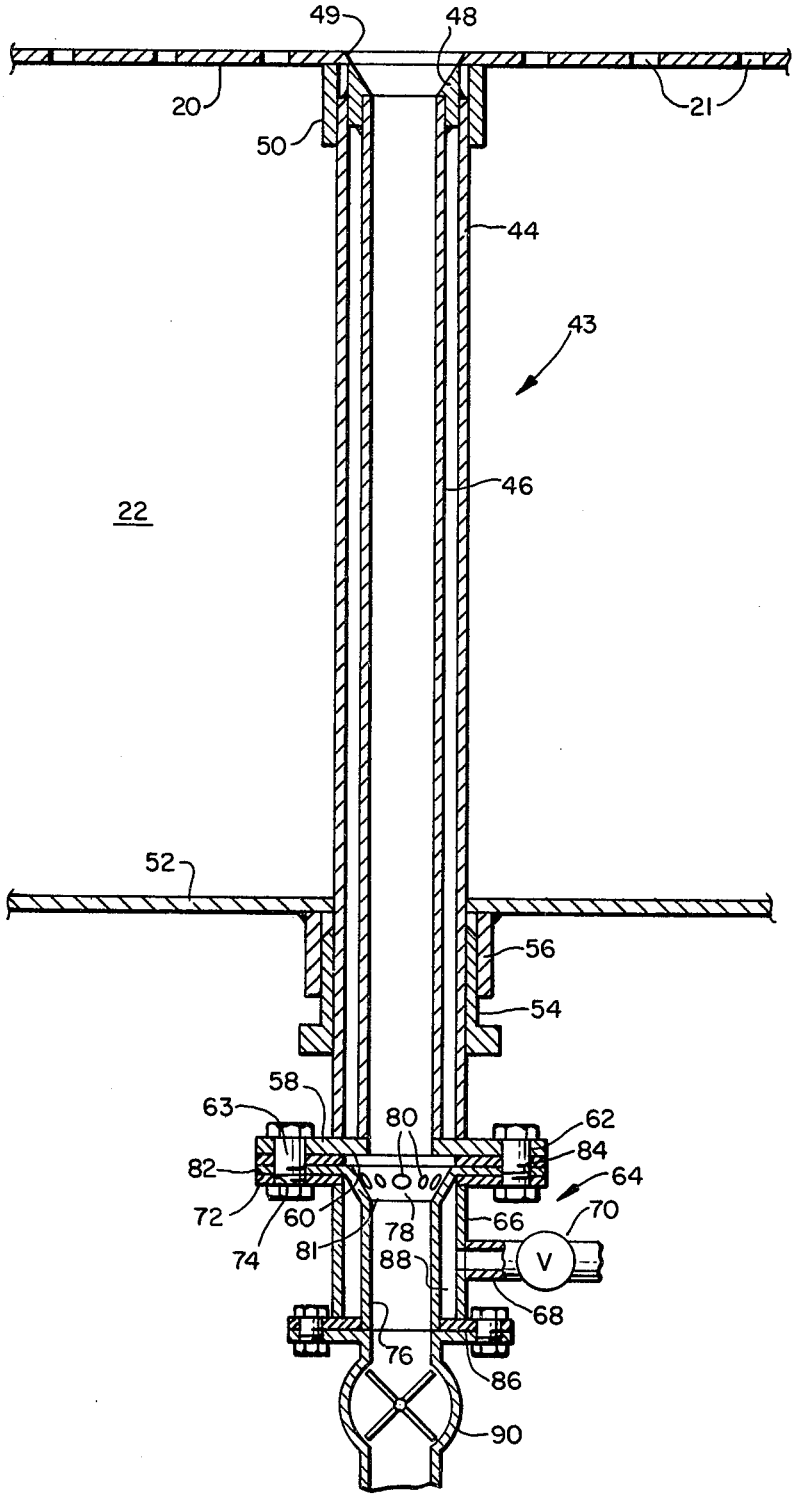
FIG. 2 is an enlarged cross-sectional view of the drain pipe of FIG. 1.

As can be seen in greater detail in FIG. 2, a drain 43 extends through the air plenum 22 and includes an outer pipe 44, an inner pipe 46 defining a throat concentrically disposed within the outer pipe 44, and a bevelled collar 48 secured between the outer and inner discharge pipes 44 and 46 at their upper ends so that an upper edge of the bevelled collar 48 is level with the lower surface of the perforated plate 20 to form a gradually narrowing inlet for the particulate coal ash entering the drain 43. The inlet is positioned at an opening 49 defined in the perforated plate 20. The bevelled collar 48 may be secured in any suitable manner, as by threadedly connecting the bevelled collar to the external surface of the inner pipe 46 and welding the bevelled collar to the outer pipe 44. The outer pipe 44 is supported by a threaded connection or other suitable connection to an annular flange 50 depending from the lower surface of the perforated plate 20. The outer and inner pipes 44 and 46 extend downwardly through a bottom wall 52 of the plenum 22 where they are guided by a collar 54 interposed between the outer pipe 44 and an annular flange 56 depending from the lower wall 52 of the plenum 22. The outer and inner pipes 44 and 46 terminate at lower ends which are welded or otherwise suitably secured to a flat annular plate 58 which extends radially outward from the lower end of the inner pipe 46. The flat annular plate 58 includes a plurality of apertures 62 spaced outward from the outer pipe 44 for receiving fasteners, such as nuts and bolts 63, to connect the flange 58 to a compressed air inlet assembly 64.

The compressed air inlet assembly 64 includes a compressed air inlet pipe 66 having a lateral inlet port 68 which is connected to a source of compressed air (not shown), the flow of compressed air to the inlet pipe 66 being controlled by a valve 70. The compressed air inlet pipe 66 includes a radially extending upper flange 72 including a plurality of apertures 74 by which the nuts and bolts 63 can connect the flange 72 to the flange 58. An inner pipe 76, including at its upper end an outwardly flaring frustoconical plate 78 having a plurality of perforations 80, is positioned concentrically within the compressed air inlet pipe 66. The frustoconical plate 78 includes a central aperture 81 through which the draining coal ash particles can pass. The upper end of the frustoconical plate 78 includes an outwardly extending flange 82 which overlies the flange 72 and includes apertures 84 in alignment with the apertures 74, so that the flange 82 can be clamped between the flanges 72 and 58 when the appropriate fasteners are installed. A lower annular flange 86 extends radially outward from the lower end of the inner pipe 76 beyond the air inlet pipe 66 so as to define, with the air inlet pipe 66, the inner pipe 76 and the frustoconical plate 78, an annular plenum chamber 88.

A suitable device, such as a rotary feeder 90, is secured at the lower end of the inner pipe 76 to control the discharge of the coal ash. Although a rotary feeder has been indicated in the drawings, other suitable discharge devices, such as screw feeders, can be employed.

In operation, the valve 26 associated with the air inlet pipe 24 is opened to allow air to pass up through the plenum 22 and through the perforations 21 in the perforated plate 20. The light-off burner 28 is then fired to heat the material in the bed until the temperature of the material reaches a predetermined level, whereby combustion is started and relatively heavy coal ash particles begin to form, at which time particulate fuel is discharged from the feeders 30, 32 and 34, and adsorbent material is discharged from other feeders (not shown) onto the upper surface of the bed 18 as needed.

After the bed 18 has been fluidized and has reached a predetermined elevated temperature in accordance with the foregoing, the light-off burner 28 is turned off while the feeders 30, 32 and 34 continue to distribute particulate fuel to the upper surface of the bed in accordance with predetermined feed rates. Fluid, such as water, to be heated is passed into the headers 40 and 42 where it passes simultaneously, or in sequence, through the tubes 14 forming the walls 8, 10 and 12 to add heat from the fluidized bed to the fluid before it is passed to external apparatus for further processing.

Compressed air is admitted to the annular plenum chamber 88 through the compressed air inlet port 68 by the manipulation of the valve 70. The compressed air flows through the perforations 80 in the frustoconical plate 78 and increases in velocity when it enters the throat defined by the inner drain pipe 46, from which it flows directly upward through the fluidized bed 18, creating a generally conical low density region in the fluidized bed above the drain 43. There is a greater volume of compressed air flowing upwardly over the drain 43 than in any other region of the fluidized bed 18. As a result, the bed material over the drain 43 is prevented from accumulating around the inlet to the drain. In addition, the material of the fluidized bed 18 tends to migrate toward the low density region over the drain 43. Furthermore, the diameter of the inner drain pipe 46 and the flow of air from the compressed air source are selected so that the air flowing up through the drain 43 defines an air screen separating the relatively lightweight adsorbent material particles from the heavier coal ash particles. Thus, when the particulate material of the fluidized bed 18 moves into the low density region over the drain 43, the flow of compressed air from the drain forces the relatively lightweight adsorbent material particles upward, but permits the heavier coal ash particles to sink into the drain 43, from which they are discharged by the rotary feeder 90 or other suitable discharge device.

There is an inherent rate of attrition of the adsorbent particles due to their reduction to fine size by the collisions and abrasions of the boiling action of the fluidized bed 18 and the resultant entrainment of the fine adsorbent particles by the fluidizing air, in which they are carried out through the flue. Thus, the adsorbent particles are normally eliminated in the flue gas, the coal ash particles are continuously discharged through the drain 43 and additional adsorbent and coal is continuously supplied to the top of the fluidized bed 18 to maintain a continuous circulation of material and a constant level in the fluidized bed 18. Since the flow of coal ash particles into the drain 43 occurs freely, rather than being unpredictably restricted or blocked by accumulations around the entrance to the drain 43, it occurs at a relatively constant rate, so that the rate of particulate material being fed to the fluidized bed 18 can be adjusted, whereby the level of the fluidized bed 18 can be precisely controlled. If it is desired to increase the rate of removal of the adsorbent material from the fluidized bed 18, the flow of compressed air through the drain pipe 43 can be reduced so that the lighter adsorbent material particles will fall through the drain pipe 43 along with the heavier coal ash particles. By adjusting the amount of compressed air flowing through the drain 43 into the fluidized bed 18 the size of particles which will be allowed to fall through the drain 43 can be controlled.

It is understood that other modifications, changes and substitutions are intended in the foregoing disclosure and, in some instances, some features of the invention will be employed without a corresponding use of other features. Accordingly, it is appropriate that the appended claims be construed broadly and in a manner consistent with the spirit and scope of the invention.

What is claimed is:

1. In a fluidized bed heat exchanger having a perforated support plate to support a bed of particulate material including a fuel material and an adsorbent material, means for introducing air through the perforations to fluidize said particulate material, means for starting combustion in said bed by which relatively heavy fuel ash particles are formed, means for introducing additional particulate material to said bed, and a drain having an inlet in said bed for discharging spent particulate material from said bed, the improvement comprising:

separating means for retaining the adsorbent material particles in the fluidized bed and for permitting the relatively heavy fuel ash particles to fall into the drain, the separating means comprising means for providing a flow of air through said drain and into said bed sufficient to retain the adsorbent material particles in the fluidized bed, but insufficient to prevent the relatively heavy fuel ash particles from falling into the drain, the air flow providing means including an element connected to and annularly arranged with respect to the drain, the element having at least one perforation in communication with said drain, directing the flow of air through said drain, and means for allowing the relatively heavy fuel ash particles to pass.

2. The apparatus of claim 1 further comprising an opening in the perforated support plate, the inlet to the drain being positioned at said opening.

3. The apparatus of claim 1 wherein the drain includes an outer pipe and a concentric inner pipe, the inner pipe defining a throat.

4. The apparatus of claim 1 wherein the element is an annular element, and the means for allowing the fuel ash particles to pass is a central aperture in the annular element.

5. The apparatus of claim 4 wherein the annular element is in the drain, the air flow providing means further includes a plenum chamber in the drain, and the at least one perforation provides communication between the plenum chamber and the drain.

6. The apparatus of claim 4 wherein the annular element comprises a frustoconical plate, and the plenum chamber is an annular plenum chamber defined in part by the frustoconical plate.

7. A method of operating a fluidized bed having a perforated support plate and a drain comprising:

supplying particulate material to the fluidized bed, including a fuel material and an adsorbent material;

supplying fluidizing air to the fluidized bed through the perforated support plate;

starting combustion in the fluidized bed by which relatively heavy fuel ash particles are formed;

providing an annular element having a central aperture and at least one perforation in communication with said drain; and discharging the fuel ash particles through the drain while retaining the adsorbent material in the fluidized bed, said discharging step comprising providing a flow of air into said drain through said perforation, through said drain and into the fluidized bed sufficient to retain the adsorbent material in the fluidized bed, but insufficient to prevent the relatively heavy fuel ash particles from falling into said drain.

8. The method of claim 7 wherein the steps of supplying particulate material to the fluidized bed and discharging fuel ash particles through the drain are done continuously.

9. The method of claim 7 wherein the supplying of particulate material is adjusted to control the level of particulate material in the fluidized bed.

* * * * *